US009643409B2

(12) United States Patent
Date

(10) Patent No.: US 9,643,409 B2
(45) Date of Patent: May 9, 2017

(54) LIQUID EJECTING APPARATUS AND SIGNAL SUPPLY APPARATUS

(71) Applicant: Seiko Epson Corporation, Tokyo (JP)

(72) Inventor: Kyohei Date, Nagano (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/010,388

(22) Filed: Jan. 29, 2016

(65) Prior Publication Data

US 2016/0279930 A1 Sep. 29, 2016

(30) Foreign Application Priority Data

Mar. 24, 2015 (JP) ..... 2015-060534

(51) Int. Cl.
*B41J 2/045* (2006.01)
*B41J 2/14* (2006.01)

(52) U.S. Cl.
CPC ..... *B41J 2/04541* (2013.01); *B41J 2/04501* (2013.01); *B41J 2/04581* (2013.01); *B41J 2/04588* (2013.01); *B41J 2/04593* (2013.01); *B41J 2/04596* (2013.01); *B41J 2/14233* (2013.01); *B41J 2002/14362* (2013.01); *B41J 2002/14491* (2013.01); *B41J 2202/20* (2013.01)

(58) Field of Classification Search
CPC ..... B41J 2/04541; B41J 2/04501
See application file for complete search history.

(56) References Cited

U.S. PATENT DOCUMENTS

2014/0375712 A1* 12/2014 Iwama ..... B41J 2/04563 347/9

FOREIGN PATENT DOCUMENTS

JP 2005-074763 A 3/2005

OTHER PUBLICATIONS

Machine translation of JP 2005-074763 A. (JP 2005-074763 A was published on Mar. 24, 2005.).*

* cited by examiner

*Primary Examiner* — Justin Seo
(74) *Attorney, Agent, or Firm* — Harness, Dickey & Pierce, P.L.C.

(57) ABSTRACT

A printing apparatus includes: a liquid ejecting module having a plurality of liquid ejecting heads; a driving substrate mounted with a driving circuit that generates a driving signal; a control unit that generates an ejection control signal; and a relay substrate. The driving signal is transferred from the driving substrate to the relay substrate via a first wire, and the driving signal is transferred from the relay substrate to the liquid ejecting module via a second wire. The ejection control signal is transferred from the control unit to the liquid ejecting module via a third wire.

8 Claims, 15 Drawing Sheets

<CONTENTS OF DECODING BY DECODERS>

| | PRINT DATA SI | T1 | | T2 | |
|---|---|---|---|---|---|
| | | Sa | Sb | Sa | Sb |
| LARGE DOT | (1, 1) | H | L | H | L |
| MEDIUM DOT | (0, 1) | H | L | L | H |
| SMALL DOT | (1, 0) | L | L | L | H |
| NON-RECORDING | (0, 0) | L | H | L | L |

MSB LSB

LIQUID EJECTING APPARATUS AND SIGNAL SUPPLY APPARATUS

The entire disclosure of Japanese Patent Application No. 2015-060534, filed Mar. 24, 2015 is expressly incorporated by reference herein.

BACKGROUND

1. Technical Field

The present invention relates to a liquid ejecting apparatus and a signal supply apparatus.

2. Related Art

A printing apparatus has been known which prints images and documents by ejecting sections ejecting liquid such as ink. The ejecting sections typically include piezoelectric elements. Each of the ejecting sections is driven in accordance with a driving signal to eject a predetermined amount of ink from a nozzle at a predetermined timing.

A known example of a technology that is applied to such a printing apparatus is a technology for supplying driving signals and the like via a relay substrate (see JP A-2005-74763).

Such a printing apparatus may have its line head replaced as measures against troubles such as failures. However, such replacement tends to undesirably entail a lot of effort and time to remove and insert (detach and attach) FFCs (flexible flat cables) via which driving signals and the like are transferred to the line head, deterioration of the FFCs, and the like.

SUMMARY

An advantage of some aspects of the invention is to provide a liquid ejecting apparatus and a signal supply apparatus that improve working efficiency with which FFCs are detached and attached and prevent deterioration in the FFCs and the like.

In order to attain the advantage, a liquid ejecting apparatus according to an aspect of the present invention includes: a line head having a plurality of liquid ejecting heads each having an ejecting section for ejecting liquid; a driving circuit that generates a driving signal that drives the ejecting section; a control unit that generates an ejection control signal that controls supply of the driving signal to the ejecting section; a relay substrate that relays transfer of the driving signal from the driving circuit to the line head; a first fire wire via which the driving circuit and the relay substrate are electrically connected to each other and the driving signal is transferred; a second wire via which the relay substrate and the line head are electrically connected to each other and the driving signal is transferred; and a third wire via which the control unit and the line head are electrically connected to each other and the ejection control signal is transferred.

In the liquid ejecting apparatus according to this aspect, the relay substrate may be provided in a frame to which the driving circuit and the control unit are attached. Furthermore, the liquid ejecting apparatus is preferably configured such that the frame is located between the driving circuit and the line head and between the control unit and the line hand and such that the frame is provided on a side of the line head.

This configuration makes it possible to replace the line head without removing the control unit and the relay substrate from the frame. Further, since the ejection control signal, which is comparatively high in frequency, is transferred without passing through the relay substrate, deterioration is prevented so that a decrease in the precision of ejection of the liquid can be suppressed.

The liquid ejecting apparatus according to the aspect is preferably configured such that the control unit has a transmitting section that converts the ejection control signal into a differential signal and outputs the differential signal to the line head and such that the line head has a receiving section that receives the differential signal and reversely converts the differential signal into the ejection control signal. According to this configuration, the ejecting control signal is converted into the differential signal before it is transferred. This makes it hard for the ejecting control signal to be affected by noise or the like.

The liquid ejecting apparatus according to the aspect is preferably configured such that the second wire is detachable from and attachable to the relay substrate via a first connector. This configuration prevents the second wire from deteriorating when the line head is replaced.

Further, the liquid ejecting apparatus may be configured such that the third wire is detachable from and attachable to the line head via a second connector.

The liquid ejecting apparatus according to the aspect is preferably configured such that the third wire is capable of transferring the ejection control signal at 3 Gbps or higher.

Examples of such signal transmission schemes include LVDS (low voltage differential signaling) and LVPECL (low-voltage positive emitter-coupled logic). Use of such an LVDS or LVPECL scheme makes it possible to transmit control signals, i.e., digital signals, on the order of GHz. This makes high-speed printing possible with simultaneous driving of a large number of ejecting sections.

Without being limited to the liquid ejecting apparatus, the present invention can be achieved in various aspects. For example, the present invention can be conceptualized as a signal supply apparatus that supplies signals to the line head.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the present invention is described below with reference to the drawings.

Figure 1:
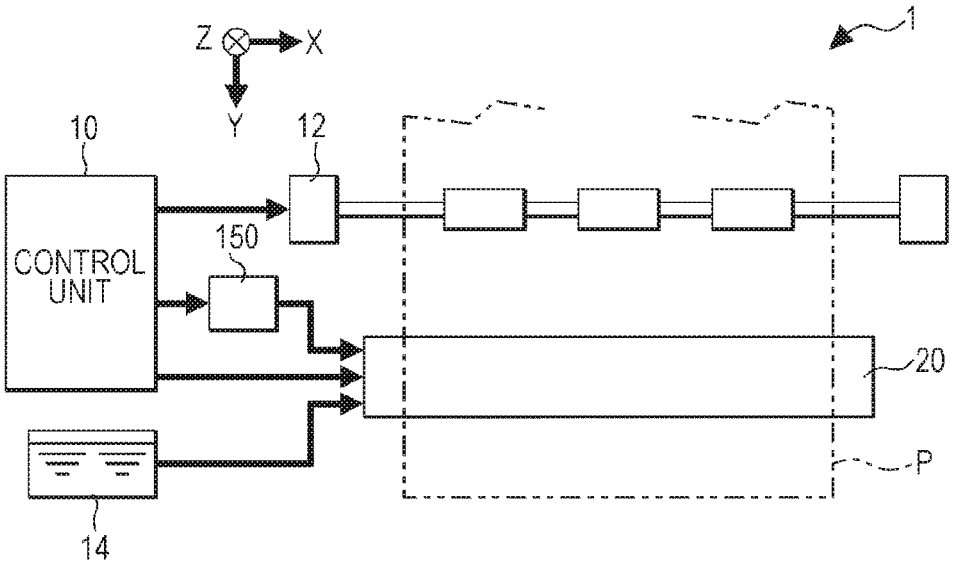
FIG. 1 is a diagram schematically showing a printing apparatus according to an embodiment.

FIG. 1 is a diagram schematically showing a printing apparatus 1 according to an embodiment.

The printing apparatus 1 is a printing apparatus (ink jet printer) that forms a group of dots of ink on a medium P such as a sheet of paper by ejecting ink (liquid) and thereby prints an image (including a character, a figure, and the like) corresponding to image data.

As shown in FIG. 1, the printing apparatus 1 includes a control unit 10, a transport mechanism 12, a liquid ejecting module 20, and a driving substrate 150. Further, the printing apparatus 1 is fitted with a liquid container (cartridge) 14 in which plural colors of ink are stored. In this example, a total of four colors of ink, namely cyan (C), magenta (M), yellow (Y), and black (B), are stored in the liquid container 14.

As will be described later, the control unit 10 is fixed in a frame (not illustrated in FIG. 1) of the printing apparatus 1 in which each component is accommodated. Meanwhile, the control unit 10 includes a control section that mainly processes image data supplied from an external host computer and controls each element of the printing apparatus 1, a transmitting section that transmits signals that are outputted from the control section, and the like. The transport mechanism 12 transports the medium P in a Y direction under the control of the control unit 10. The liquid ejecting module 20 ejects, under the control of the control unit 10, the ink stored in the liquid container 14. In this embodiment, the liquid ejecting module 20 is a line head whose long sides extend in an X direction intersecting (typically orthogonal to) the Y direction. The driving substrate 150 generates and amplifies the after-mentioned driving signals and the like in accordance with the control unit 10 and supplies them to the liquid ejecting module 20.

The printing apparatus 1 forms an image on a surface of the medium P by the liquid ejection module 20 ejecting the ink onto the medium P in synchronization with the transportation of the medium P by the transport mechanism 12.

The term "Z direction" as used hereinafter means a direction perpendicular to an X-Y plane (i.e., a plane parallel to the surface of the medium P). The Z direction is typically a direction of ejection of the ink from the liquid ejecting module 20.

Figure 2:
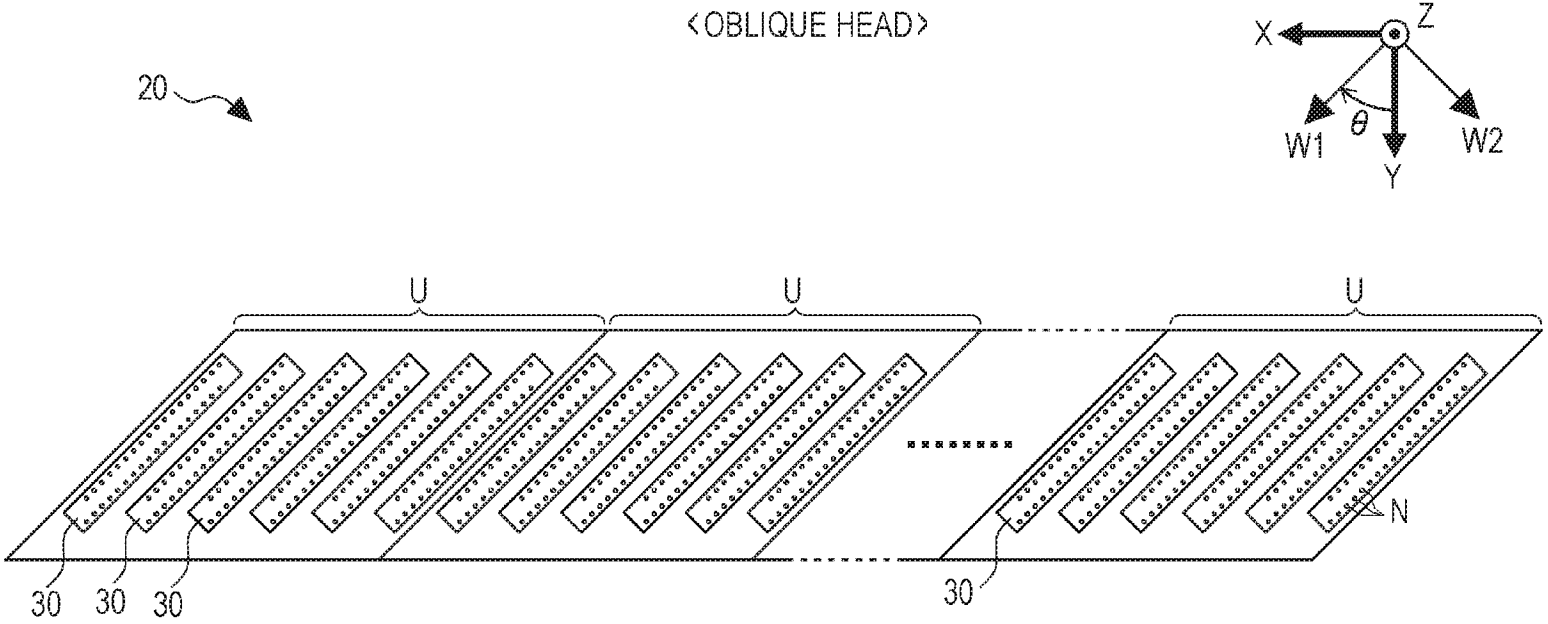
FIG. 2 is a plan view of the main components of a liquid ejecting module.

FIG. 2 is a plane view of the liquid ejecting module 20 as seen from the medium P.

As shown in FIG. 2, the liquid ejecting module 20 is configured such that a plurality of liquid ejecting units U, which form the basis of the liquid ejecting module 20, are arranged along the X direction. Furthermore, each of the liquid ejecting units U includes a plurality of liquid ejecting heads 30 arranged along the X direction. Each of the liquid ejecting heads 30 includes a plurality of nozzles N arranged in two rows inclined with respect to the Y direction, i.e., the direction of transportation of the medium P.

For convenience of explanation, the present embodiment assumes that the number of liquid ejecting units U that constitute the liquid ejecting module 20 is "6" and the number of liquid ejecting heads 30 that constitute each of the liquid ejecting units U is "6". Therefore, the total number of liquid ejecting heads 30 in the liquid ejecting module 20 is "36".

Further, the liquid ejecting module 20 includes the after-mentioned assembly substrate and the after-mentioned relay substrate in addition to the six liquid ejecting units U.

Figure 3:
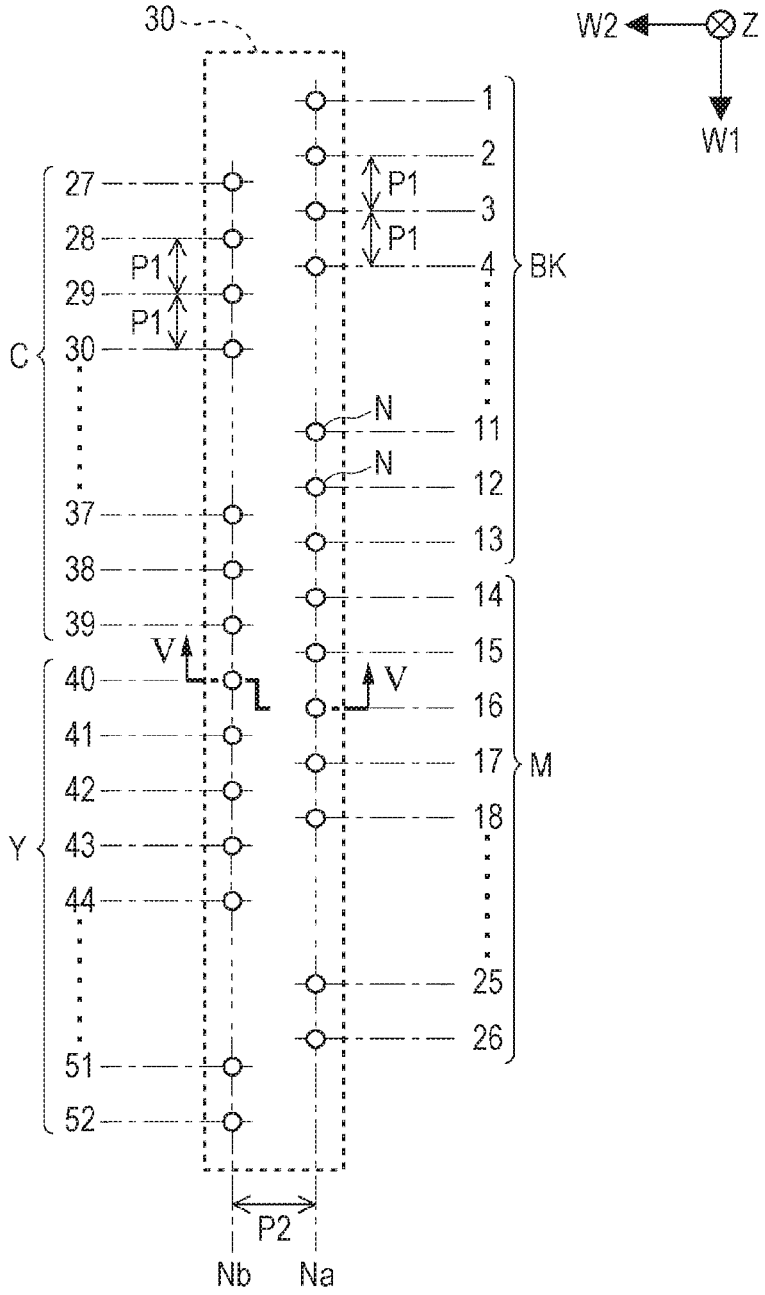
FIG. 3 is a diagram showing an arrangement of nozzles in a liquid ejecting head.

FIG. 3 is a diagram for explaining an arrangement of nozzles N in each of the liquid ejecting heads 30. Unlike FIG. 2, FIG. 3 is a transparent view as seen from a side opposite to the medium P in the direction of ejection of the ink. As mentioned above, each of the liquid ejecting heads 30 includes a plurality of nozzles N in two inclined rows. First, however, an arrangement of nozzles in each of the liquid ejecting heads 30 is discussed here without consideration of inclination.

As shown in FIG. 3, the nozzles N of the liquid ejecting head 30 are divided into nozzle rows Na and Nb. In each of the nozzle rows Na and Nb, the plurality of nozzles N are arranged at pitches P1 along a W1 direction. Further, the nozzle rows Na and Nb are spaced at a pitch P2 from each other in a W2 direction orthogonal to the W1 direction. The nozzles N belonging to the nozzle row Na and the nozzles N belonging to the nozzle row Nb are out of alignment with each other by half the pitches P1 in the W1 direction.

FIG. 3 indicates nozzle numbers that specify the nozzles N and the like hereinafter. In this example, the nozzles N of the nozzle row Na are assigned nozzle numbers 1, 2, . . . , 25, and 26 in a sequential order starting from a nozzle N located at an end on a negative side (in FIG. 3, an upper side) of the W1 direction. The nozzles N of the nozzle row Nb are assigned the subsequent nozzle numbers 27, 28, . . . , 51, and 52 in a sequential order starting from a nozzle N located at an end on the negative side of the W1 direction.

FIG. 3 also indicates a relationship of correspondence with colors of ink that are ejected from the nozzles N. In this example, the nozzle N with nozzle numbers "1" to "13" correspond to black (Bk). The nozzle N with nozzle numbers "14" to "26" correspond to magenta (M). The nozzle N with nozzle numbers "27" to "39" correspond to cyan (C). The nozzle N with nozzle numbers "40" to "52" correspond to yellow (Y).

In FIG. 3, the number of nozzles N is "52". Note, however, that this is merely an example.

Figure 4:
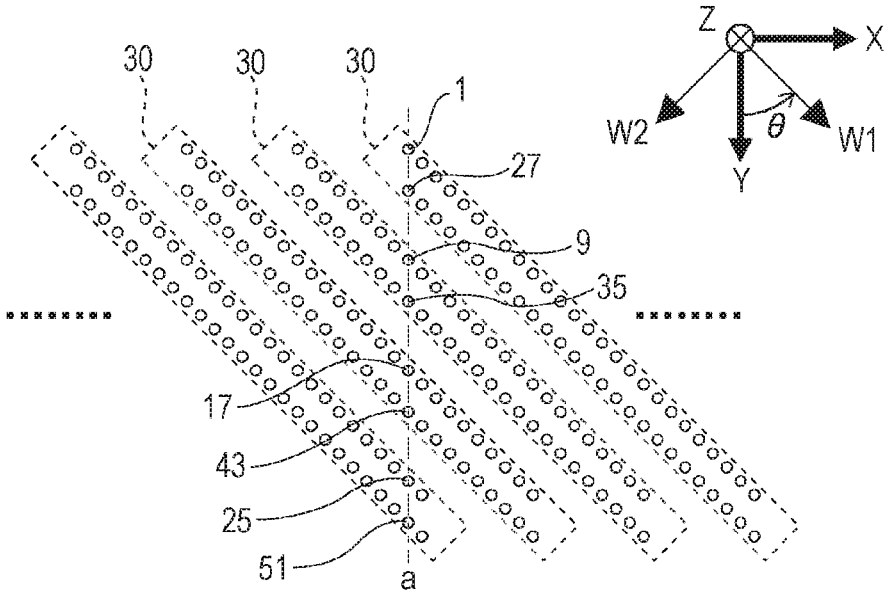
FIG. 4 is a diagram showing arrangements of nozzles in liquid ejecting heads.

FIG. 4 is a diagram showing a positional relationship between the nozzles N in an inclined arrangement of the liquid ejecting heads 30. As with FIG. 3, FIG. 4 is a transparent view as seen from a side opposite to the medium P in the direction of ejection of the ink. It should therefore be noted that FIGS. 2 and 4 are opposite in direction of inclination to each other.

As shown in FIG. 4, the liquid ejecting heads 30 are arranged at an angle θ of inclination that is neither parallel nor orthogonal to the Y direction, i.e., the direction of transportation of the medium P. Note here that the nozzles N belonging to the nozzle rows Na and the nozzles N belonging to the nozzle rows Nb share common positions (coordinates) in the X direction.

For example, in the case of a liquid ejecting head 30 of interest located at the right end in FIG. 4, the angle θ is set so that one nozzle N (i.e., the nozzle N with nozzle number "1") in the nozzle row Na which is located at the negative-side end of the W1 direction and one nozzle N (i.e., the nozzle N with nozzle number "27") in the nozzle row Nb which is located at the negative-side end of the W1 direction pass through an imaginary line a extending in a direction parallel to the Y direction.

Further, the surrounding liquid ejecting heads 30 have the following positional relationships with the liquid ejecting head 30 of interest. That is, a liquid ejecting head 30 located adjacent to the liquid ejecting head 30 of interest on the left but one has such a positional relationship with the liquid ejecting head 30 of interest that the nozzle N with nozzle number "17" and the nozzle N with nozzle number "43" pass through the imaginary line a.

This makes it possible to, when the medium P is transported in the Y direction, form a color dot by causing black (B) ink ejected from the nozzle N with nozzle number "1" of a liquid ejecting head 30, cyan (C) ink ejected from the nozzle N with nozzle number "27" of the liquid ejecting head 30, magenta (M) ink ejected from the nozzle N with nozzle number "17" of a liquid ejecting head 30 located adjacent to the former liquid ejecting head 30 on the left but one, and yellow (Y) ink ejected from the nozzle N with nozzle number "43" of the latter liquid ejecting head 30 to land on substantially the same position.

It should be noted that a liquid ejecting head 30 located immediately adjacent to the liquid ejecting head 30 of interest on the left has such a positional relationship with the liquid ejecting head 30 of interest that the nozzle N with nozzle number "9" and the nozzle N with nozzle number "35" pass through the imaginary line a. It should also be noted that a liquid ejecting head 30 located adjacent to the liquid ejecting head 30 of interest on the left but two has such a positional relationship with the liquid ejecting head 30 of interest that the nozzle N with nozzle number "25" and the nozzle N with nozzle number "51" pass through the imaginary line a. This puts two nozzles N of each color on the imaginary line a, thus making it possible to perform a process, for example, in which ink is ejected from the nozzle N located upstream and the ejection of ink from the nozzle located downstream is restricted.

Although FIG. 4 shows only the nozzle numbers of the nozzles that pass through the imaginary line a, the nozzles N with nozzle numbers "2" and "28", for example, of the liquid ejecting head 30 of interest and the nozzles N with nozzle numbers "18" and "44" of the liquid ejecting head 30 located adjacent to the liquid ejecting head 30 of interest on the left but one share common positions in the X direction, and when seen along the Y direction, the nozzles of four colors are configured to pass. The other nozzles exhibit similar positional relationships.

Figures 14, 15:
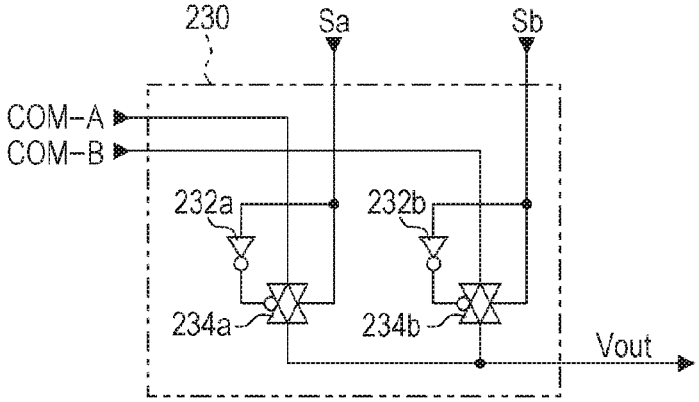
FIG. 14 is a table showing the contents of decoding by decoders.
FIG. 15 is a diagram showing a configuration of a selection section.

FIG. 15 is a cross-sectional view showing a structure of each of the liquid ejecting heads 30. In detail, FIG. 5 is a diagram showing a cross-section taken along the line V-V in FIG. 3 (i.e., a cross-section perpendicular to the W1 direction as seen from a positive side toward a negative side of the W1 direction).

Figure 5:
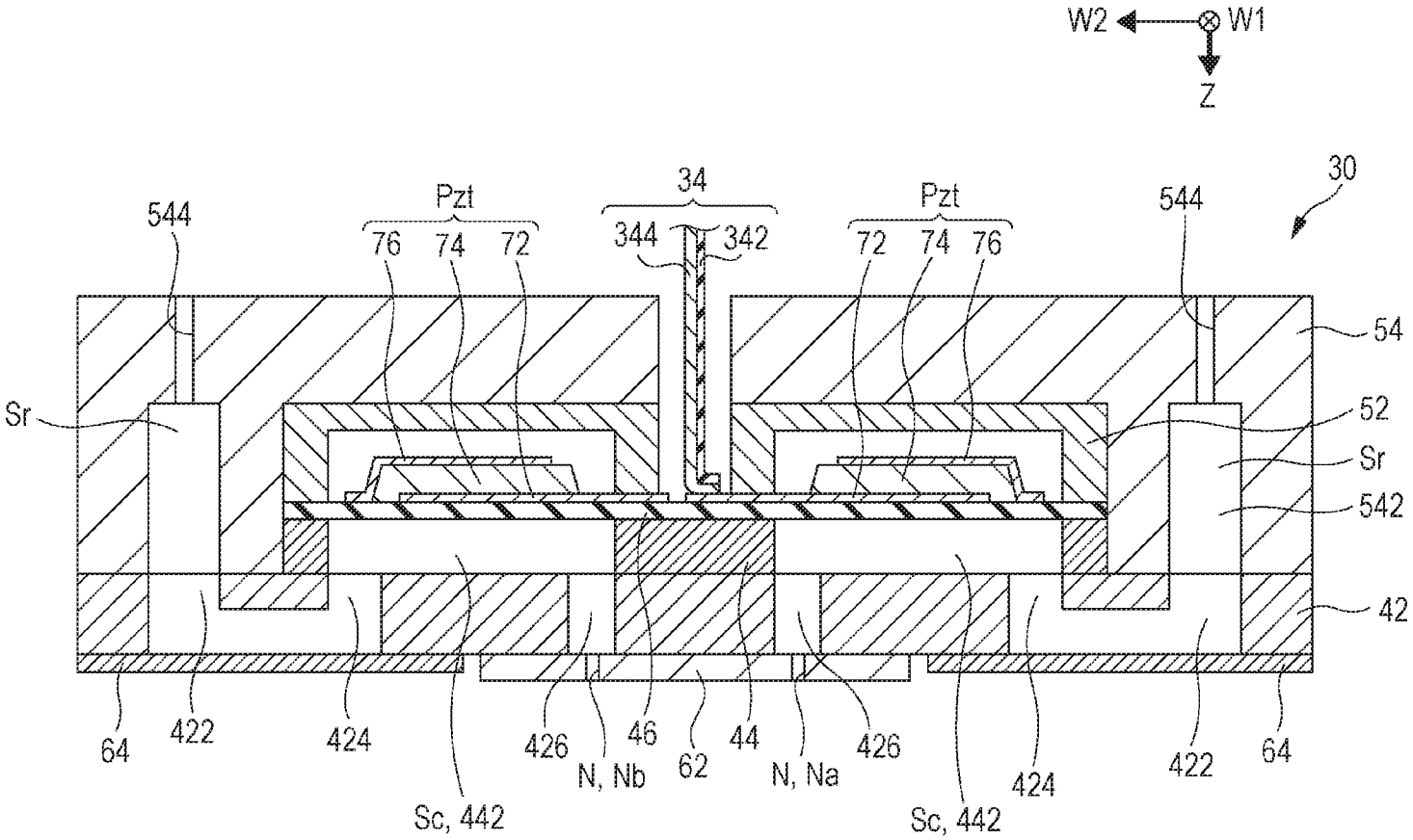
FIG. 5 is a cross-sectional view showing a structure of a liquid ejecting head.

As shown in FIG. 5, the liquid ejecting head 30 is a structural body (head chip) including a flow channel substrate 42, a pressure chamber substrate 44, a vibrating plate 46, a sealing body 52, a supporting body 54, a nozzle plate 62, and a compliance section 64. The pressure chamber substrate 44, the vibrating plate 46, the sealing body 52, and the supporting body 54 are placed on a surface of the flow channel substrate 42 on a negative side of the Z direction. Meanwhile, the nozzle plate 62 and the compliance section 64 are placed on a surface of the flow channel substrate 42 on a positive side of the Z direction. These elements of the liquid ejecting head 30 are each a member that is substantially in the shape of a flat plate whose long sides schematically extend in the W1 direction as mentioned above, and are fixed to each other, for example, with an adhesive. Further, the flow channel substrate 42 and the pressure chamber substrate 44 are formed, for example, by silicon single crystal substrates.

The nozzles N are formed in the nozzle plate 62. In the liquid ejecting head 30, as schematically shown in FIG. 3, structures corresponding to the nozzles belonging to the nozzle row Na and structures corresponding to the nozzles belonging to the nozzle row Nb are out of alignment with each other by half the pitches P1 in the W1 direction. Except for that, these structures are formed substantially symmetrically. Therefore, the following describes the structure of the liquid ejecting head 30 with attention focused on the nozzle row Na.

The flow channel substrate 42 is a flat-plate member that forms flow channels through which ink flows, and includes openings 422, supply flow channels 424, and communicating flow channels 426. The supply flow channels 424 and the communicating flow channels 426 are formed for each separate nozzle, and each of the openings 422 is formed to continue across a plurality of nozzles from which ink of the same color is ejected.

The supporting body 54 is fixed to the surface of the flow channel substrate 42 on the negative side of the Z direction. The supporting body 54 includes accommodating sections 542 and introductory flow channels 544. In a plan view (i.e., when seen in the Z direction), the accommodating sections 542 are depressions (recesses) corresponding in outer shape to the openings 422 of the flow channel substrate 42, and the introductory flow channels 544 are flow channels that communicate with the accommodating sections 542.

A space formed by communication between each of the openings 422 of the flow channel substrate 42 and a corresponding one of the accommodating sections 542 of the supporting body 54 functions as a liquid storage chamber (reservoir) Sr. These liquid storage chambers Sr are formed independently of each other for each separate color of ink, and store ink having passed through the liquid container (see FIG. 1) and the introductory flow channels 544. That is, each of the liquid ejecting heads 30 includes four liquid storage chambers Sr corresponding to different colors of ink.

The compliance section 64 is an element that constitutes bottom surfaces of the liquid storage chambers Sr and suppresses (absorbs) fluctuations in pressure of ink in the liquid storage chambers Sr and internal flow channels. The compliance section 64 includes a flexible member formed, for example, in the shape of a sheet and, specifically, is fixed to the surface of the flow channel substrate 42 in such a manner as to close the openings 422 and each supply flow channel 424 in the flow channel substrate 42.

The vibrating plate 46 is placed on a surface of the pressure chamber substrate 44 opposite to the flow channel substrate 42. The vibrating plate 46 is a member that is in the shape of a flat plate capable of elastic vibration. The vibration plate 46 is constituted, for example, by stacking of an elastic film made of an elastic material such as silicon oxide and an insulating film made of an insulating material such as zirconium oxide. The vibrating plate 46 and the flow channel substrate 42 face each other at a distance from each other inside of each of the openings 442 in the pressure chamber substrate 44. The space in each of the openings 442 which is interposed between the flow channel substrate 42 and the vibrating plate 46 functions as a pressure chamber Sc that applies pressure to ink. These pressure chambers Sc communicate with the nozzles N via the communicating flow channels 426 of the flow channel substrate 42, respectively.

Formed on a surface of the vibrating plate 46 opposite to the pressure chamber substrate 44 are piezoelectric elements Pzt corresponding to the nozzles N (pressure chambers Sc).

Each of the piezoelectric elements Pzt includes a driving electrode 72 formed on the surface of the vibrating plate 46 for each separate piezoelectric element Pzt, a piezoelectric body 74 formed on a surface of the driving electrode 72, and a driving electrode 76 formed on a surface of the piezoelectric body 74. It should be noted that a region in which the driving electrodes 72 and 76 face each other with the piezoelectric body 74 interposed therebetween functions as the piezoelectric element Pzt.

The piezoelectric body 74 is formed in a step including heat treatment (firing). Specifically, the piezoelectric body 74 is formed by applying a piezoelectric material onto the surface of the vibrating plate 46 on which the plurality of driving electrodes 72 have been formed, firing the piezoelectric material by heat treatment in a firing furnace, and then molding (e.g., plasma milling) the piezoelectric material for each separate piezoelectric element Pzt.

A portion of each of the driving electrode 72 is exposed from the sealing body 52 and the supporting body 54. To this exposed portion, a first end of a wiring substrate 34 is firmly fixed by a binding material.

The wiring substrate 34 includes a base film 342, such as polyimide, having insulating properties and flexibility, a plurality of wires 344 patterned on the base film 342, and, as will be described later, a semiconductor chip mounted thereon. The driving electrode 72 is electrically connected to a wire 344 of the wiring substrate 34, and this connection achieves a configuration in which the voltage Vout of a driving signal is applied to a first end of each separate piezoelectric element Pzt.

Meanwhile, although not illustrated, the plurality of piezoelectric elements Pzt have their driving electrodes 76 commonly connected and each routed from the sealing body 52 and the supporting body 54 to the exposed portion to be electrically connected to another wire 344 of the wiring substrate 34. This connection achieves a configuration in which a constant voltage (e.g., the after-mentioned voltage $V_{BS}$) is commonly applied to second ends of the plurality of piezoelectric elements Pzt.

In each of the piezoelectric elements Pzt thus configured, the central portions of the driving electrodes 72 and 76 and the vibrating plate 46 with respect to the periphery bend upward or downward with respect to both end portions of the driving electrodes 72 and 76 and the vibrating plate 46 in response to the voltages applied to the driving electrodes 72 and 76. Specifically, the piezoelectric element Pzt is configured to bend upward when the voltage Vout of the driving signal that is applied via the driving electrode 72 becomes lower, and to bend downward when the voltage Vout becomes higher.

Note here that whereas upward bending enlarges the internal volume of the pressure chamber Sc and thereby causes the ink to be sucked in from the liquid storage chamber Sr, downward bending reduces the internal volume of the liquid storage chamber Sr and thereby causes droplets of ink to be elected from the nozzles N depending on the degree of the reduction.

This achieves a configuration in which application of an appropriate driving signal to a piezoelectric element Pzt causes the ink to be ejected from the nozzle N by displacement of the piezoelectric element Pzt. Therefore, an ejecting section (i.e., a broadly-defined ejecting section) that ejects ink is constituted by elements including the pressure chamber Sc, the nozzle N, and the like, together with the piezoelectric element Pzt. However, it is also possible to think that the target to be driven by a driving signal is absolutely a piezoelectric element Pzt and only displacement of the piezoelectric element Pzt causes the ink to be ejected. Therefore, the piezoelectric element Pzt may be referred to as "narrowly-defined ejecting section".

Figure 6:
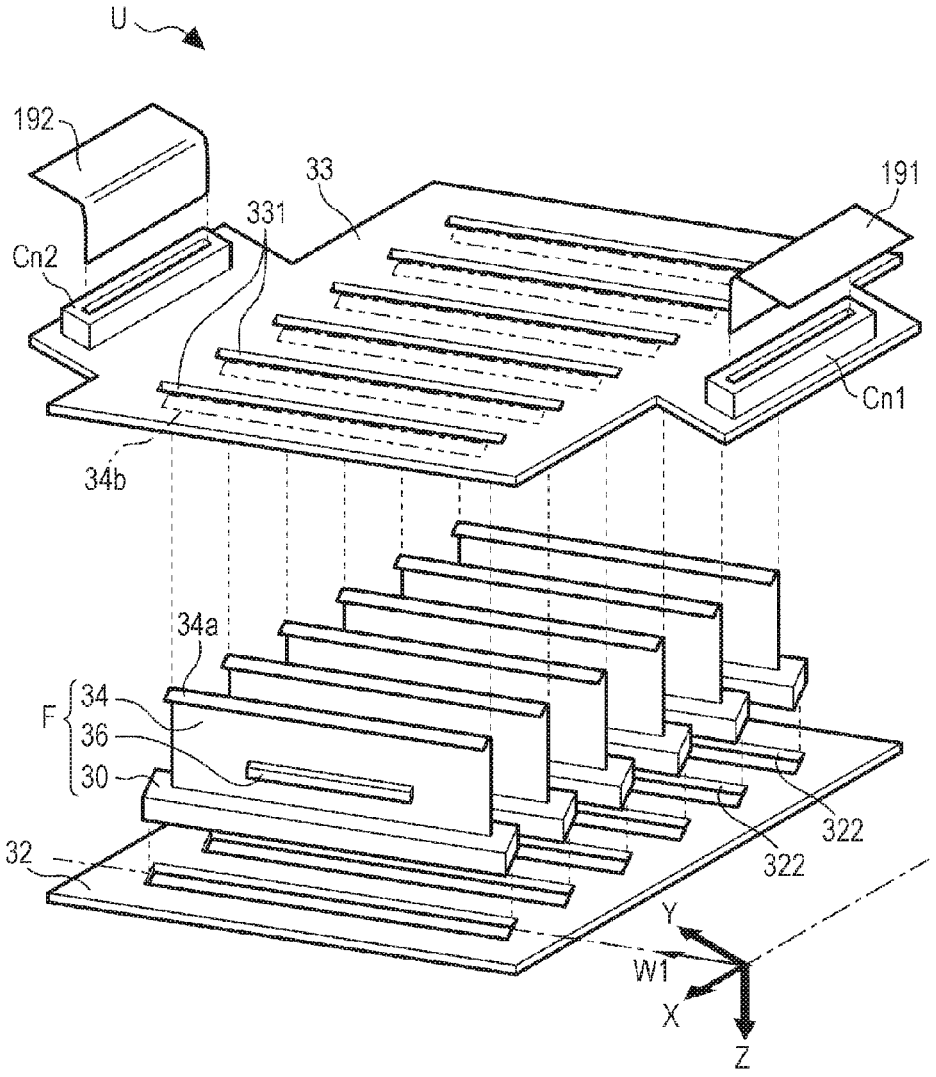
FIG. 6 is an exploded perspective view of a liquid ejecting unit.

FIG. 6 is an exploded perspective view for showing a configuration of each of the liquid ejecting units U.

As shown in FIG. 6, a fixing plate 32, which is in the shape of a flat plate, has six openings 322 formed therein. Each of the six liquid ejecting heads 30 is fixed to a surface of the fixing plate 32 so that the nozzles N are exposed at the openings 322.

A head substrate 33 has six slits 331 provided therein in such a manner as to respectively correspond to the liquid ejecting heads 30. A second end 34*a* of each of the wiring substrates 34 is inserted into a corresponding one of the slits 331 and then connected by a binding material or soldering to a terminal provided in a corresponding region 34*b* on an upper surface of the head substrate 33.

A connector Cn1 is provided on a positive side of the head substrate 33 in the Y direction so that a plurality of analog signals described below are supplied via an FFC 191. Meanwhile, a connector Cn2 is provided on a negative side of the head substrate 33 in the Y direction so that a plurality of digital signals described below are supplied via an FFC 192.

The head substrate 33 is patterned with wires (not illustrated) that lead the analog signals and the digital signals to the terminals provided in the regions 34*b*. This achieves a configuration in which when the second end 34*a* of each of the wiring substrates 34 is connected to a corresponding one of the regions 34*b* of the head substrate 33, the analog signals supplied to the connector Cn1 and the digital signals supplied to the connector Cn2 are transferred to a semiconductor chip 36 mounted on that wiring substrate 34.

In other words, a first configuration is achieved in which the analog signals and the digital signals are supplied to the liquid ejecting unit U in a separated state, i.e., in which when seen in a plan view in the Z direction, the analog signals are supplied to the arrangement of liquid ejecting heads 30 from one side (from an upstream side of the direction of transportation of the medium P) and the digital signals are supplied to the arrangement of liquid ejecting heads 30 from the other side (from a downstream side of the direction of transportation of the medium P), and a second configuration is achieved in which the analog signals and the digital signals are supplied to the semiconductor chips 36 via the head substrate 33 and the wiring substrates 34.

For convenience of explanation, a liquid ejecting head 30, a wiring substrate 34, and a semiconductor chip 36 mounted on the wiring substrate 34 may be collectively referred to as "head block F". That is, the term "head block F" as used herein means an assembly of electrical functional blocks including a liquid ejecting head 30, a wiring substrate 34 connected to the liquid ejecting head 30, and a semiconductor chip 36 mounted on the wiring substrate 34.

Figure 7:
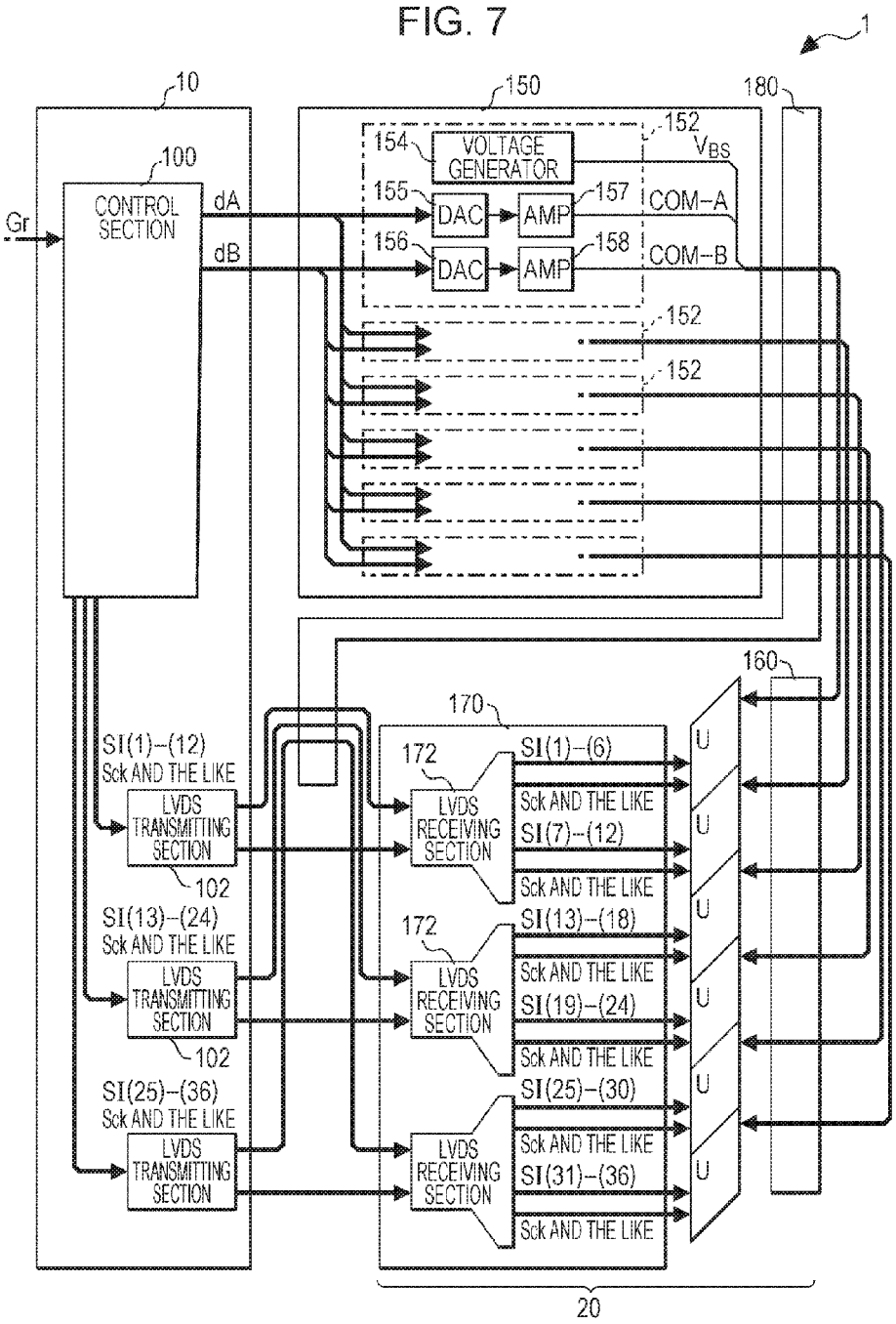
FIG. 7 is a block diagram showing a functional configuration of the printing apparatus.

FIG. 7 is a block diagram showing a functional configuration of the printing apparatus 1.

As shown in FIG. 7, the printing apparatus 1 includes the control unit 10, the liquid ejecting module 20, the driving substrate 150, and an FFC relay substrate 180. Among them, the liquid ejecting module 20 includes a relay substrate 160 and an assembly substrate 170 in addition to the six liquid ejecting units U.

Further, the control unit 10 includes a control unit 100 and three transmitting sections 102. Schematically speaking, the control unit 100 executes the following processes and outputs the following signals.

That is, first, the control unit 100 executes a predetermined program to perform image processing such as a complementary process and an arrangement conversion process on image data Gr supplied from a host computer (not illustrated) and then outputs the image data Gr as print data SI(1) to SI(36).

The complementary process refers to a process in which for example in the case of a defect in a nozzle, a dot to be formed by the defective nozzle is formed by using nozzles surrounding the defective nozzles. The arrangement conversion process refers to a process in which, for example, image data Gr defining an arrangement of pixels by orthogonal coordinates is converted into a coordinate system corresponding to an inclined arrangement of nozzles N.

The print data SI(1) to SI(36) define, for each separate liquid ejecting head 30, dots to be formed on the medium P in a single cycle of printing. When the thirty-six liquid ejecting heads 30 are identified as the first, second, third, . . . , thirty-fifth, and thirty-sixth liquid ejecting heads 30 in a sequential order from the negative side toward the positive side of the X direction, the parenthesized number following the reference sign SI of each piece of print data indicates to which of the liquid ejecting heads 30 the print data is supplied. For example, the print data SI(3) indicates that it is supplied to the third liquid ejecting head 30, and the print data SI(19) indicates that it is supplied to the nineteenth liquid ejecting head 30.

As mentioned above, each of the liquid ejecting units U is constituted by six liquid ejecting heads 30. Therefore, when seen in a sequential order from the negative side toward the positive side of the X direction, the first, second, third, fourth, fifth, and sixth liquid ejecting units U correspond to the print data SI(1) to SI(6), the print data SI(7) to SI(12), the print data SI(13) to SI(18), the print data SI(19) to SI(24), the print data SI(25) to SI(30), and the print data SI(31) to SI(36), respectively.

Second, the control unit 100 outputs a clock signal Sck and control signals LAT and CH in synchronization with the print data SI(1) to SI(36).

As will be described later, the print data SI(1) to SI(36), the clock signal Sck, and the control signals LAT and CH may be collectively referred to as "ejection control signals", as these signals control a driving signal that is supplied to the first end of each of the piezoelectric elements Pzt. Further, among the ejection control signals, the clock signal Sck and the control signals LAT and CH, excluding the print data SI(1) to SI(36), may be referred to as "clock signal Sck and the like" for convenience.

Meanwhile, with attention focused on frequencies, the print data SI(1) to SI(36) and the clock signal Sck may be referred to as "high-frequency signals", as they are comparatively high in frequency, and the control signals LAT and CH may be referred to as "low-frequency signals", as they are comparatively low in frequency.

Third, the control unit 100 outputs digital data dA and dB in synchronization with the print data SI(1) to SI(36), the clock signal Sck, and the control signals LAT and CH. The data dA and dB define waveforms of driving signals COM-A and COM-B, respectively, among driving signals that are supplied to the liquid ejecting heads 30.

In addition, the control unit 100 controls the transport mechanism 12 to control the transportation of the medium P in the Y direction. However, a description of a configuration therefor is omitted.

Each of the transmitting sections 102 multiplexes high-frequency signals, namely print data corresponding to two liquid ejecting units U and the clock signal Sck, and low-frequency signals, namely the control signals LAT and CH, into each separate single-end digital signal, converts the digital signals into differential signals, and transmits the differential signals. In the present embodiment, LVDS is used as a system for transmitting these differential signals. Alternatively, LVPECL may be used.

Since the number of liquid ejecting units U in the present embodiment is 6, the number of transmitting sections 102 that are used is 3. That is, the first transmitting section 102 outputs differential signals into which high-frequency signals, namely the print data SI(1) to SI(12) corresponding to the first and second liquid ejecting units U and the clock signal Sck, have been multiplexed and differential signals into which low-frequency signals, namely the control signals LAT and CH have been multiplexed. The second transmitting section 102 outputs differential signals into which high-frequency signals, namely the print data SI(13) to SI(24) corresponding to the third and fourth liquid ejecting units U and the clock signal Sck, have been multiplexed and differential signals into which low-frequency signals, namely the control signals LAT and CH have been multiplexed. The third transmitting section 102 outputs differential signals into which high-frequency signals, namely the print data SI(25) to SI(36) corresponding to the fifth and sixth liquid ejecting units U and the clock signal Sck, have been multiplexed and differential signals into which low-frequency signals, namely the control signals LAT and CH have been multiplexed.

Although FIG. 7 illustrates the three transmitting sections 102 as separate entities, they may be integrated into one chip together with other functions in the form of a custom IC or the like.

In the liquid ejecting module 20, the assembly substrate 170 includes three receiving sections 172 that also serve as distributing sections. The three receiving sections 172 are for example in one-to-one correspondence with the transmitting sections 102, respectively.

Each of the receiving sections 172 reversely converts the two sets of multiplexed differential signals into single-end signals, respectively, and demultiplexes the signals. As such, each of the receiving section 172 converts print data corresponding to two liquid ejecting units U, the clock signal Sck, and the control signals LAT and CH back into digital signals and supplies the digital signals to the corresponding liquid ejecting units U.

This allows the first, second, third, fourth, fifth, and sixth liquid ejecting units U to be supplied with the clock signal Sck and the control signals LAT and CH, together with the respectively corresponding print data SI(1) to SI(6), SI(7) to SI(12), SI(13) to SI(18), SI(19) to SI(24), SI(2) to SI(30), and SI(31) to SI(36).

Such multiplexing of the print data, the clock signal Sck, and the like enables a reduction in the number of wiring cables via which the control unit 10 and the assembly substrate 170 are connected to each other. Further, the conversion of the print data, the clock signal Sck, and the like into differential signals enables noise-robust transfer at high frequencies.

It should be noted that each of these digital signals has a L level of 0 volt and a H level of 3.3 volts. Alternatively, each of the receiving sections 172 may include, as separate entities, a functional portion that reversely converts received differential signals into single-end digital signals and a portion serving as a demultiplexer that separates reversely converted digital signals.

The driving substrate 150 includes six driving circuits 152. The six driving circuits 152 are for example in one-to-one correspondence with the liquid ejecting units U, respectively. Each of the driving circuits 152 includes a voltage generating section 154, DA converters (DAC) 155 and 156, and amplifier circuits (AMP) 157 and 158.

The voltage generating section 154 generates a signal of voltage $V_{BS}$ and commonly applies the signal to the second ends of the plurality of piezoelectric elements Pzt. The DA converter 155 converts the digital data dA into an analog signal, and the amplifier circuit 157 subjects the analog signal for example to class D amplification and outputs the amplified signal as a driving signal COM-A. Similarly, the DA converter 156 converts the digital data dB into an analog signal, and the amplifier circuit 158 amplifies the analog signal and outputs it as a driving signal COM-B. Note here that the driving signals COM-A and COM-B and the signal of voltage $V_{BS}$ may be referred to as "driving signals and the like" for convenience.

The driving signals and the like that are outputted by the driving circuit 152 are supplied to the corresponding liquid ejecting unit U via the FFC relay substrate 180 and the relay substrate 160.

Since the six driving circuits 152 are supplied with the common data dA and dB, the six driving circuits 152 output driving signals COM-A having waveforms in common with each other and driving signals COM-B having waveforms in common with each other. In this example, however, the driving signals COM-A and COM-B are parallelized to ensure driving performance.

Figure 8:
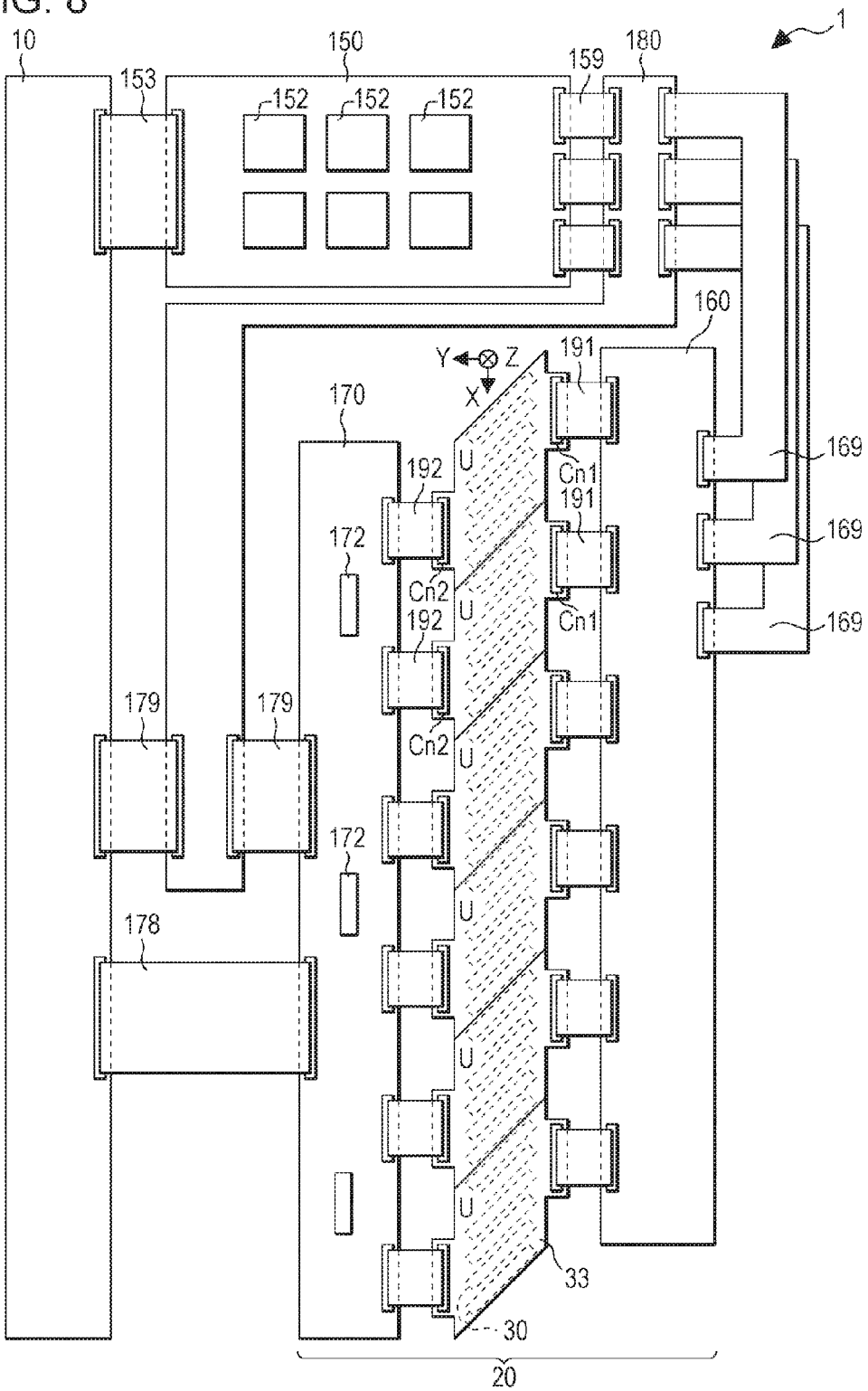
FIG. 8 is a diagram showing connections between substrates in the printing apparatus.

FIG. 8 is a diagram showing connections between the substrates in the printing apparatus 1.

It should be noted that FIG. 8 merely shows the connections between the substrates, an arrangement of the substrates, and the like, and as such, is not an accurate representation of the shape of each substrate.

As shown in FIG. 8, the relay substrate 160 and the assembly substrate 170 are located on the upstream and downstream sides, respectively, of the direction of transportation of the medium P with respect to the liquid ejecting module 20 having the six liquid ejecting units U arranged in the X direction. In other words, the relay substrate 160 and the assembly substrate 170 are placed on one side and the other, respectively, so that the liquid ejecting module 20 (liquid ejecting heads 30) are interposed therebetween.

The control unit 10 supplies the data dA and dB to the driving substrate 150 via an FFC 153. Further, the control unit 10 supplies differential signals of low-frequency signals to the assembly substrate 170 of the liquid ejecting module 20 via an FFC 177, the FFC relay substrate 180, and an FFC 179 in sequence. Meanwhile, the control unit 10 supplies differential signals of high-frequency signals to the assembly substrate 170 via an FFC 178 (third wire).

In other words, whereas differential signals of low-frequency signals are supplied to the assembly substrate 170 via the FFC relay substrate 180, differential signals of high-frequency signals are supplied to the assembly substrate 170 without passing through the FFC relay substrate 180.

It is preferable that the FFC 178, via which differential signals of high-frequency signals are transferred, be capable of transferring data at 3 Gbps (giga bits per second) or higher. The transfer per se is possible with a scheme of band spreading by LVDS.

The driving signals and the like that are outputted from the six driving circuits 152 are supplied by the driving substrate 150 to the relay substrate 160 of the liquid ejecting module 20 via FFCs 159 (first wires), the FFC relay substrate 180, and FFCs 169 (second wires) in sequence. In this example, two sets of driving signals and the like are supplied to the relay substrate 160 via one set of FFCs 159 and 169.

The relay substrate 160 rearranges six sets of driving signals and the like supplied via three FFCs 169 so that the six sets of driving signals and the like are in one-to-one correspondence with the six liquid ejecting units U. Then, each of the sets of driving signals and the like rearranged by the relay substrate 160 is supplied to one side of the corresponding liquid ejecting unit U via the FFC 191 and the connector Cn1.

In the assembly substrate 170, each of the receiving sections 172 receives differential signals, reversely converts them into single-end signals, and separate them into print data corresponding to two liquid ejecting units U, the clock signal Sck, and the like. The print data, the clock signal Sck, and the like thus separated are supplied to the other side of each of the corresponding liquid ejecting units U via the FFC 192 and the connector Cn2.

Thus, each of the liquid ejecting units U is supplied with analog driving signals and the like from one side and with print data, the clock signal Sck, and the like from the other side in such a manner that the arrangement of liquid ejecting heads 30 are interposed therebetween.

Figure 9:
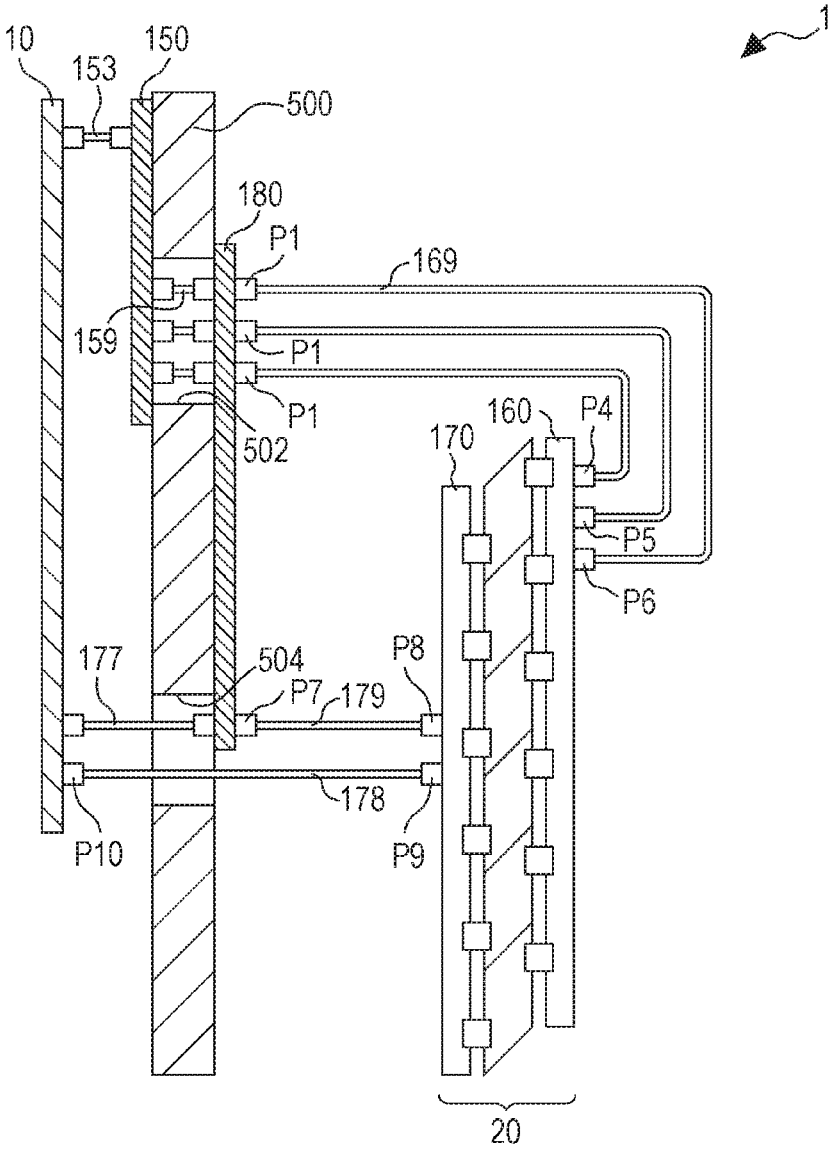
FIG. 9 is a diagram showing the connections between the substrates in the printing apparatus.
Figure 10:
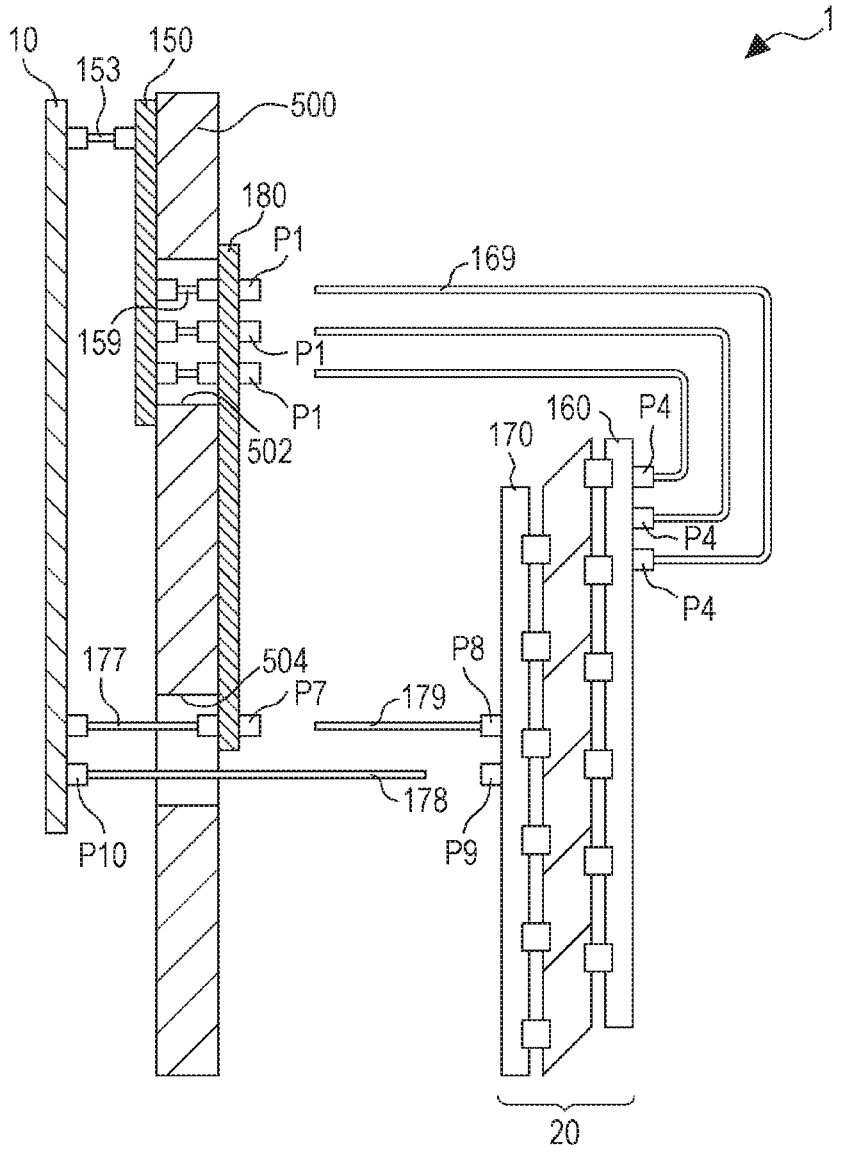
FIG. 10 is a diagram showing the connections between the substrates in the printing apparatus.

FIGS. 9 and 10 are diagrams showing how the liquid ejecting module 20 is connected to the control unit 10, the driving substrate 150, and the FFC relay substrate 180.

As shown in FIG. 9, the control unit 10 and the driving substrate 150 are attached to a surface of a frame 500 of metal or the like opposite to a side of the frame 50 on which the liquid ejecting module 20 is provided.

The control unit 10 is attached to the frame 500 via a spacer (not illustrated) so that the control unit 10 and the frame 500 are placed at a distance from each other. On the other hand, the driving substrate 150 is directly attached to the frame 500 using a screw or the like with insulating properties ensured so that heat generated by the amplifier circuits 157 and 158 is released via the frame 500. Further, as stated above, the control unit 10 and the driving substrate 150 are connected to each other via the FFC 153 via which the data dA and dB are transferred.

To the side of the frame 500 on which the liquid ejecting module 20 is provided, the FFC relay substrate 180 is attached using a screw or the like with insulating properties ensured.

The frame 500 is provided with openings 502 and 504. The FFC relay substrate 180 closes a portion of the opening 504.

As stated above, the driving substrate 150 and the FFC relay substrate 180 are connected to each other via the FFCs 159. The FFCs 159 are inserted through the opening 502. Further, as stated above, the control unit 10 and the FFC relay substrate 180 are connected to each other via the FFC 117. The FFC 177 is inserted through the opening 504.

In the liquid ejecting module 20, the relay substrate 160 is connected to the FFC substrate 180 via the FFCs 169, and the assembly substrate 170 is connected to the FFC substrate 180 via the FFC 179 and to the control unit 10 via the FFC 178. The FFC 178 is inserted through the opening 504.

It should be noted that the three FFCs 169 are inserted into connectors P1 (first connectors) on a side of the FFC relay substrate 180, and are inserted into connectors P4 on a side of the relay substrate 160.

Further, the FFC 179 is inserted into a connector P7 on the side of the FFC relay substrate 180, and is inserted into a connector P8 on a side of the assembly substrate 170. The FFC 178 is inserted into a connector P10 on a side of the control unit 10, and is inserted into a connector P9 (second connector) on the side of the assembly substrate 170.

The liquid ejecting module 20 needs to be replaced as appropriate in preparation for failures, passage of its useful life, and the like.

As shown in FIG. 10, in a case where the liquid ejecting module 20 is detached, the FFCs 169 are pulled out from the three connectors P1, respectively, and the FFC 179 is pulled out from the connector P7. Further, the FFC 178 is pulled out from the connector P9.

On the other hand, in a case where a new liquid ejecting module 20 is attached, the FFCs 169 are inserted into the three connectors P1, respectively, and the FFC 179 is inserted into the connector P7. Further, the FFC 178 is inserted into the connector P9.

In the present embodiment, the FFC relay substrate 180 are attached to the side of the frame 500 on which the liquid ejecting module 20 is provided. This eliminates the need to remove the control unit 10 and the driving substrate 150 from the frame 500 in replacing the liquid ejecting module 20. This enables a shortening of time required for replacement work.

With this point described in detail, for the prevention of a malfunction due to electromagnetic noise that is generated from the liquid ejecting module 20, the control unit 10 (and the driving substrate 150) is (are) configured to be shielded from the liquid ejecting module 20 by the frame 500; that is, the frame 500 is configured to be interposed between the control unit 10 and the liquid ejecting module 20. This makes it necessary to remove the control unit 10 and the driving substrate 150 from the frame 500 to detach and attach FFCs.

Such a structure is conceivable that the FFCs 169 are detached from and attached to the connectors P4 and the FFC 179 is detached from and attached to the connector P7. However, the liquid ejecting module 20 is an assembly of the plurality of liquid ejecting heads 30, the relay substrate 160, and the assembly substrate 170, and as such, is a precision product. Further, rubbing of an FFC during replacement of the liquid ejecting module 20 may cause deterioration of the FFC.

For this reason, it is desirable that the liquid ejecting module 20 be replaceable together with the FFCs, and a structure in which the FFCs are detached from and attached to a side of the liquid ejecting module 20 is should be avoided.

However, the FFC 178, via which high-frequency signals are transferred, is exceptionally configured to be detached from and attached to the connector P9 of the liquid ejecting module 20, as noise contamination or the like due to the interposition of many connectors should be avoided. This configuration prevents deterioration of high-frequency signals including the print data SI, thus making it possible to suppress a reduction in the precision of ejection of the liquid.

Next, an electrical configuration of the liquid ejecting module 20 is described.

Figure 11:
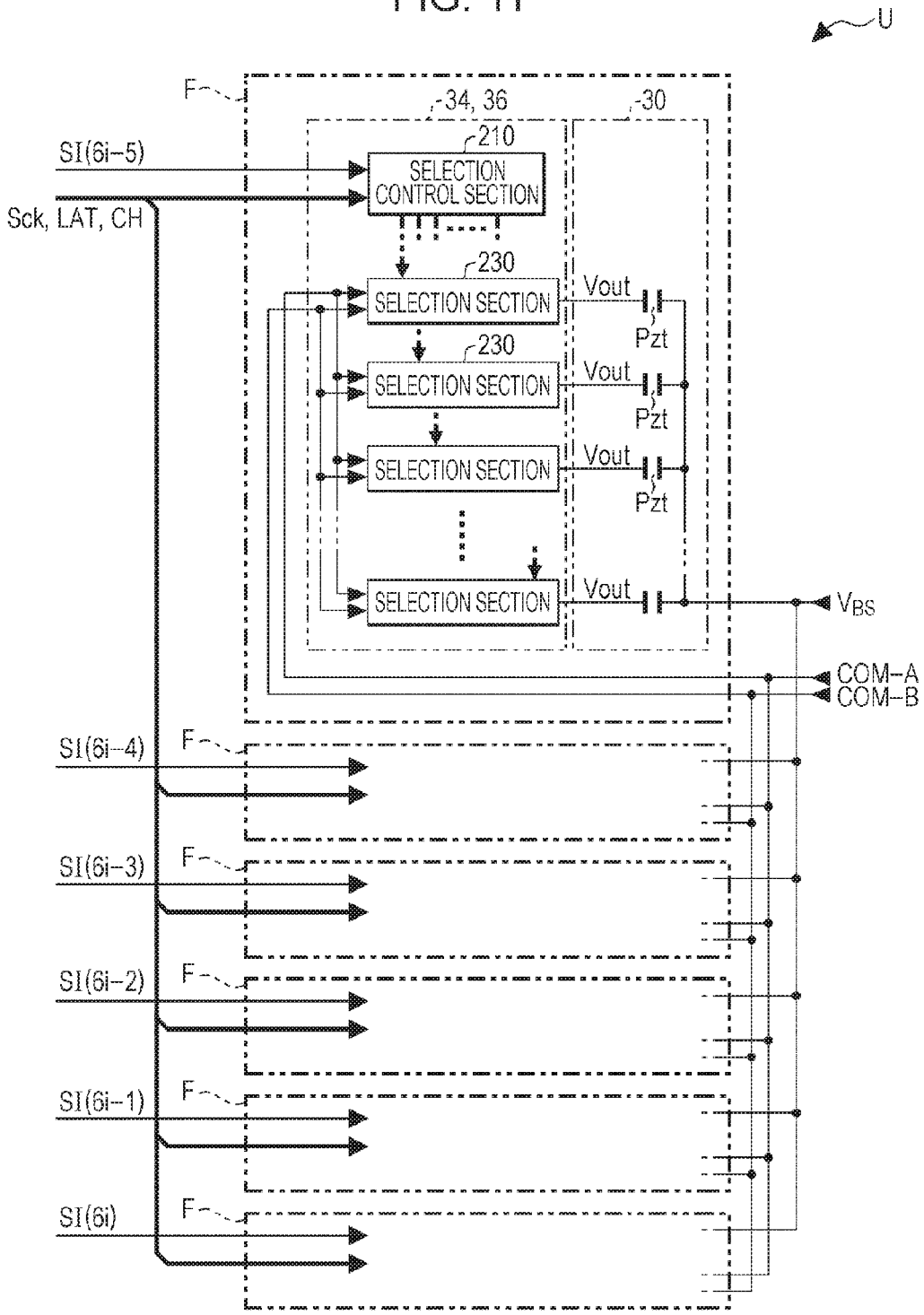
FIG. 11 is a block diagram showing an electrical configuration of a head block.

FIG. 11 is a diagram showing an electrical configuration of each of the liquid ejecting units U. Since the first to sixth liquid ejecting units U are identical in configuration to each other, the ith (where i is an integer of 1 to 6) liquid ejecting unit U is described here for convenience.

As mentioned above, the liquid ejecting unit U is constituted by six head blocks F in terms of its electrical configuration, and each of the head blocks F is constituted by a wiring substrate 34, a semiconductor chip 36, and a liquid ejecting head 30.

The semiconductor chip 36 mounted on the wiring substrate 34 of the head block F functionally includes a selection control section 210 and a plurality of selection sections 230 paired with nozzles N. Meanwhile, the liquid ejecting head 30 is electrically constituted by a plurality of piezoelectric elements Pzt (in the example shown in FIG. 3 and the like, two rows of twenty-six piezoelectric elements Pzt, i.e., fifty-two piezoelectric elements Pzt).

In each of the liquid ejecting units U, the six head blocks F are identical in configuration to each other, and the ith liquid ejecting unit U is constituted by six liquid ejecting heads 30, namely the (6i−5)th, (6i−4)th, (6i−3)th, (6i−2)th, (6i−1)th, and (6i)th liquid ejecting heads 30. The selection control sections 210 corresponding to these liquid ejecting heads 30 are supplied with print data SI(6i−5), SI(6i−4), SI(6i−3), SI(6i−2), SI(6i−1), and SI(6i) in a sequential order, as well as the clock signal Sck and the like.

Since the head blocks F are identical in configuration to each other, the head block F including the (6i−5)th liquid ejecting head 30 is described here for convenience.

In the head block F, the selection control section 210 distributes the print data SI(6i−5) in correspondence with each of the piezoelectric elements Pzt, and each of the selection sections 230 selects the driving signal COM-A or COM-B (or puts both into the unselected state) in accordance with the print data distributed thereto, and supplies the driving signal to the first end of the corresponding piezoelectric element Pzt, i.e., to the driving electrode 72 (see FIG. 5).

In FIG. 11, the voltage of the driving signal selected by the selection section 230 is denoted by Vout in distinction from the driving signals COM-A and COM-B.

As mentioned above, the voltage VBS is commonly applied to the second ends of the piezoelectric elements Pzt.

In the present embodiment, one dot is expressed by any of four levels of gray, namely a large dot, a medium dot, a small dot, and non-recording, by ejecting ink from one nozzle N at most twice. To express these four levels of gray, the present embodiment prepares two types of driving signals COM-A and COM-B and gives each cycle a first-half pattern and a second-half pattern. Moreover, in the first and second halves of each cycle, the driving signal COM-A or COM-B is selected (or not selected) according to the level of gray to be expressed, and is supplied to the piezoelectric element Pzt.

Therefore, the driving signals COM-A and COM-B are described first, and then a configuration for selecting between the driving signals COM-A and COM-B is described.

Figure 12:
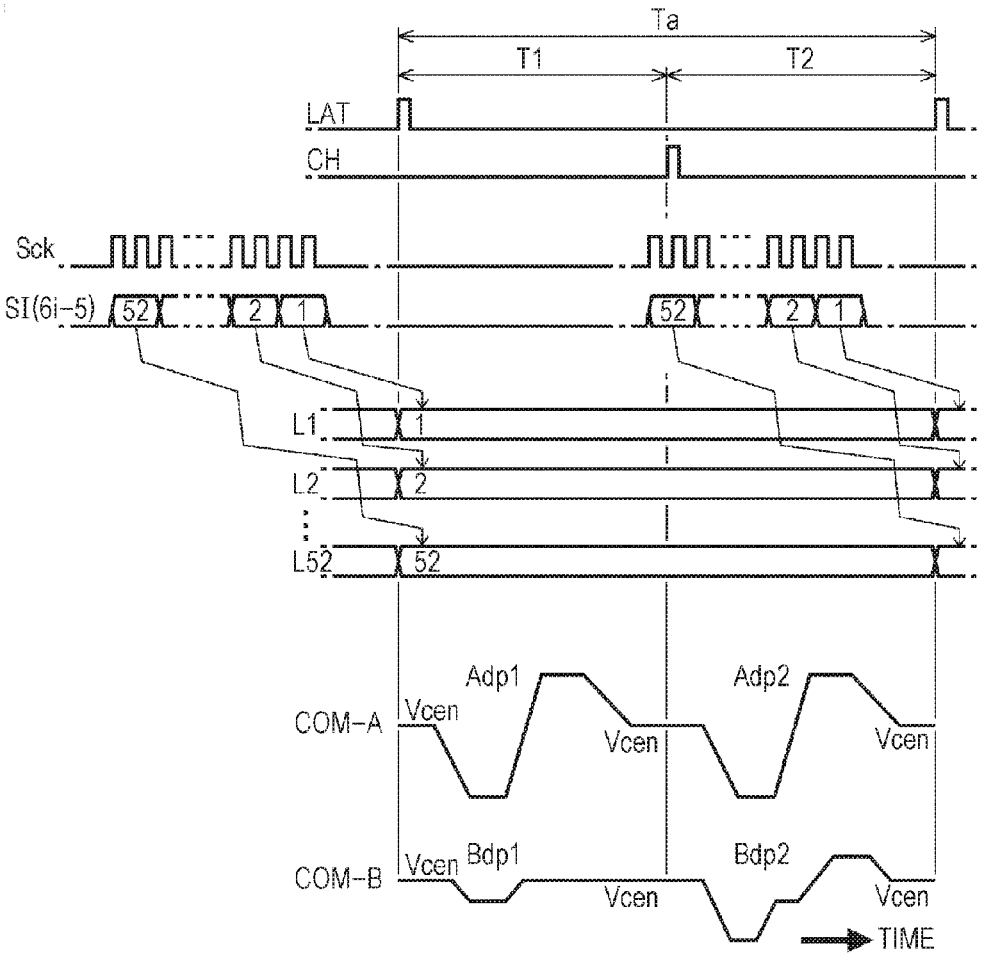
FIG. 12 is a chart for explaining how a selection control section operates.

FIG. 12 is a chart showing the waveforms of the driving signals COM-A and COM-B and the like.

As shown in FIG. 12, the driving signal COM-A has a waveform of repetition of a trapezoidal waveform Adp1 and a trapezoidal waveform Adp2. The trapezoidal waveform Adp1 is placed in a period T1 of each cycle of printing Ta from the output (rising edge) of the control signal LAT to the output of the control signal CH. The trapezoidal waveform Adp2 is placed in a period T2 of the cycle of printing Ta from the output of the control signal CH to the output of the next control signal LAT.

In the present embodiment, the trapezoidal waveforms Adp1 and Adp2 are substantially identical to each other. When supplied to the first end of a piezoelectric element Pzt, each of the trapezoidal waveforms Adp1 and Adp2 causes a predetermined amount of ink or, specifically, a moderate amount of ink to be ejected from the nozzle N corresponding to the piezoelectric element Pzt.

The driving signal COM-B has a waveform of repetition of a trapezoidal waveform Bdp1 placed in the period T1 and a trapezoidal waveform Bdp2 placed in the period T2. In the present embodiment, the trapezoidal waveforms Bdp1 and Bdp2 are different from each other. The trapezoidal waveform Bdp1 causes microvibration of ink around an orifice of a nozzle N and thereby prevents an increase in viscosity of the ink. Therefore, even when the trapezoidal waveform Bdp1 is supplied to the first end of a piezoelectric element Pzt, no droplet of ink is ejected from the nozzle N corresponding to the piezoelectric element Pzt. Further, the trapezoidal waveform Bdp2 is different from the trapezoidal waveform Adp1 (Adp2). When supplied to the first end of a piezoelectric element Pzt, the trapezoidal waveform Bdp2 causes an amount of ink smaller than the predetermined amount to be ejected from the nozzle N corresponding to the piezoelectric element Pzt.

It should be noted that the trapezoidal waveforms Adp1, Adp2, Bdp1, and Bdp2 share a common voltage Vcen at the start and end timings thereof. That is, each of the trapezoidal waveforms Adp1, Adp2, Bdp1, and Bdp2 starts and ends at the voltage Vcen.

Further, the trapezoidal waveform Adp1 has a maximum voltage value of approximately 42 volts.

Figure 13:
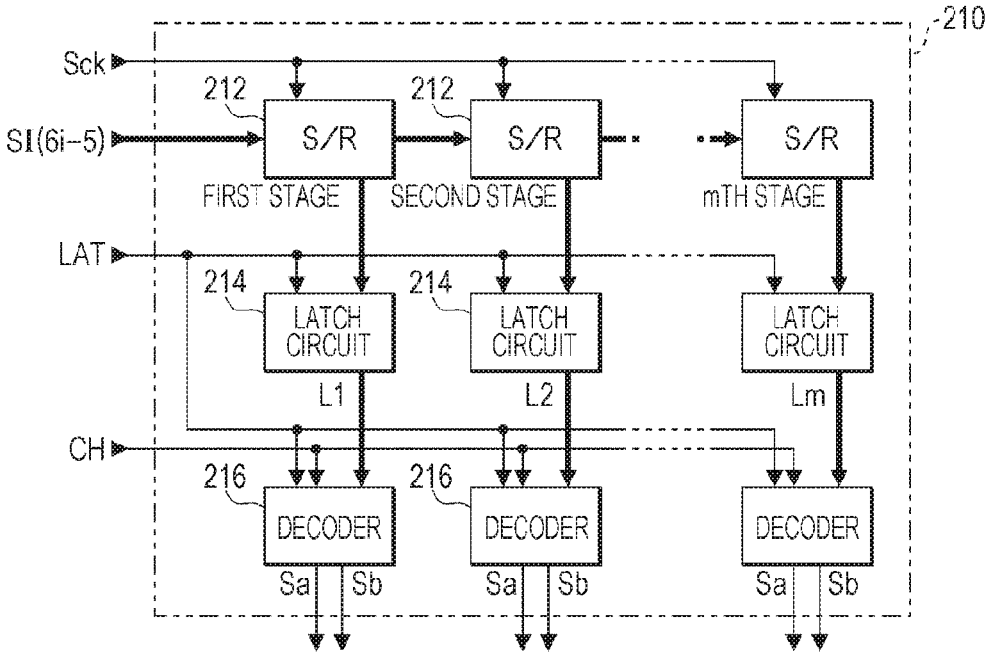
FIG. 13 is a diagram showing a configuration of the selection control section.

FIG. 13 is a diagram showing a configuration of the selection control section 210 shown in FIG. 11.

As shown in FIG. 13, the selection control section 210 is supplied with the clock signal Sck, the print data SI(6i−5), and the control signals LAT and CH. The selection control section 210 includes combinations of shift registers (S/R) 212, latch circuits 214, and decoders 216 respectively corresponding to the piezoelectric elements Pzt (nozzles N).

The print data SI(6i−5) defines dots that are to be formed by all of the (fifty-two) nozzles N of the (6i−5)th liquid ejecting head 30 in a cycle of printing Ta. In the present embodiment, print data corresponding to one nozzle is composed of two bits, namely an upper bit (MSB) and a lower bit (LSB), to express any of four levels of gray, namely non-recoding, a small dot, a medium dot, and a large dot.

The print data SI(6i−5) is supplied in time with the transportation of the medium P for each separate nozzle N (piezoelectric element Pzt) in synchronization with the clock signal Sck. Two bits of the print data SI(6i−5) that correspond to each nozzle N are temporarily held by a corresponding one of the shift registers 12.

In detail, the shift registers 212, which correspond in stage number to the piezoelectric elements Pzt (nozzles), are connected in a cascade arrangement, and print data SI supplied to the shift register 212 of the first stage located at the left end in FIG. 13 is transferred to the subsequent stages in sequence in accordance with the clock signal Sck.

In the present embodiment, the number of piezoelectric elements Pzt (nozzles) is "52". For the sake of identification, the shift registers 212 are denoted by the first, second, . . . , and fifty-second stages in a sequential order starting from an upstream side from which the data SI(6i−5) is supplied.

Each of the latch circuits 214 latches, at the rising edge of the control signal LAT, the print data held by the corresponding shift register 212. Note that since the print data held by the shift register 212 is not the print data SI(6i−5) corresponding to the fifty-two nozzles but corresponds to one nozzle, the print data is simply denoted by the sign "SI" for the sake of avoiding confusion.

Each of the decoders 216 decodes the two bits of print data SI latched by the corresponding latch circuit 214, outputs selection signals Sa and Sb for each of the periods T1 and T2 defined by the control signals LAT and CH, and defines a selection that the corresponding selection section 230 makes.

FIG. 14 is a table showing the contents of decoding by the decoders 216.

In FIG. 14, two bits of print data SI latched are denoted by (MSB, LSB). This means that for example when the print data SI latched is (0, 1), each of the decoders 216 outputs the selection signals Sa and Sb at logical levels of H and L, respectively, in the period T1 and L and H, respectively, in the period T2.

The logic levels of the selection signals Sa and Sb are level-shifted to higher amplitude logic by a level shifter (not illustrated) than the logic levels of the clock signal Sck, the print data SI, and the control signals LAT and CH.

FIG. 15 is a diagram showing a configuration of each of the selection sections 230 shown in FIG. 11.

As shown in FIG. 15, each of the selection sections 230 includes inverters (NOT circuits) 232*a* and 232*b* and transfer gates 234*a* and 234*b*.

The selection signal Sa from the corresponding decoder 216 is supplied to an uncircled positive control terminal of the transfer gate 234*a*, and is logically inverted by the inverter 232*a* and supplied to a circled negative control terminal of the transfer gate 234*a*. Similarly, the selection signal Sb is supplied to a positive control terminal of the transfer gate 234*b*, and is logically inverted by the inverter 232*b* and supplied to a negative control terminal of the transfer gate 234*b*.

The driving signal COM-A is supplied to an input terminal of the transfer gate 234*a*, and the driving signal COM-B is supplied to an input terminal of the transfer gate 234*b*. Output terminals of the transfer gates 234*a* and 234*b* are commonly connected and each connected to the first end of the corresponding piezoelectric element Pzt.

The transfer gate 234*a* brings its input and output terminals into conduction (i.e., into an on-state) when the selection signal Sa is at a H level, and brings its input and output terminals out of conduction (i.e., into an off-state) when the selection signal Sa is at a L level. Similarly, the transfer gate 234*b* brings its input and output terminals into an on- or off-state according to the selection signal Sb.

As shown in FIG. 12, the print data SI(6i−5) is supplied in descending order of nozzle number in synchronization with the clock signal Sck for each nozzle, and is transferred in sequence by the shift registers 212 corresponding to the nozzles. Then, when the supply of the clock signal Sck stops, the shift registers 212 come to hold print data SI corresponding to the respective nozzle numbers.

At the rising edge of the control signal LAT, the latch circuits 214 concurrently latch the print data SI held by the shift registers 212. In FIG. 12, the numbers within L1, L2, . . . , and L52 indicate the nozzle numbers of the print data SI latched by the latch circuits 214 corresponding to the shift registers 212 of the first, second, . . . , and fifty-second stages, respectively.

The decoders 216 output the selection signals Sa and Sb at such logic levels as those shown in FIG. 14 in each of the periods T1 and T2 according to the sizes of dots defined by the print data SI thus latched.

That is, first, each of the decoders 216 sets the selection signals Sa and Sb at H and L levels, respectively, in the first period T1 and also sets the selection signals Sa and Sb at H and L levels, respectively, in the period T2 in a case where the corresponding print data SI is (1, 1) and defines the size of a large dot. Second, each of the decoders 216 sets the selection signals Sa and Sb at H and L levels, respectively, in the first period T1 and sets the selection signals Sa and Sb at L and H levels, respectively, in the period T2 in a case where the corresponding print data SI is (0, 1) and defines the size of a medium dot. Third, each of the decoders 216 sets both the selection signals Sa and Sb at a L level in the first period T1 and sets the selection signals Sa and Sb at L and H levels, respectively, in the period T2 in a case where the corresponding print data SI is (1, 0) and defines the size of a small dot. Fourth, each of the decoders 216 sets the selection signals Sa and Sb at L and H levels, respectively, in the first period T1 and sets both the selection signals Sa and Sb at a L level in the period T2 in a case where the corresponding print data SI is (0, 0) and defines non-recording.

Figure 16:
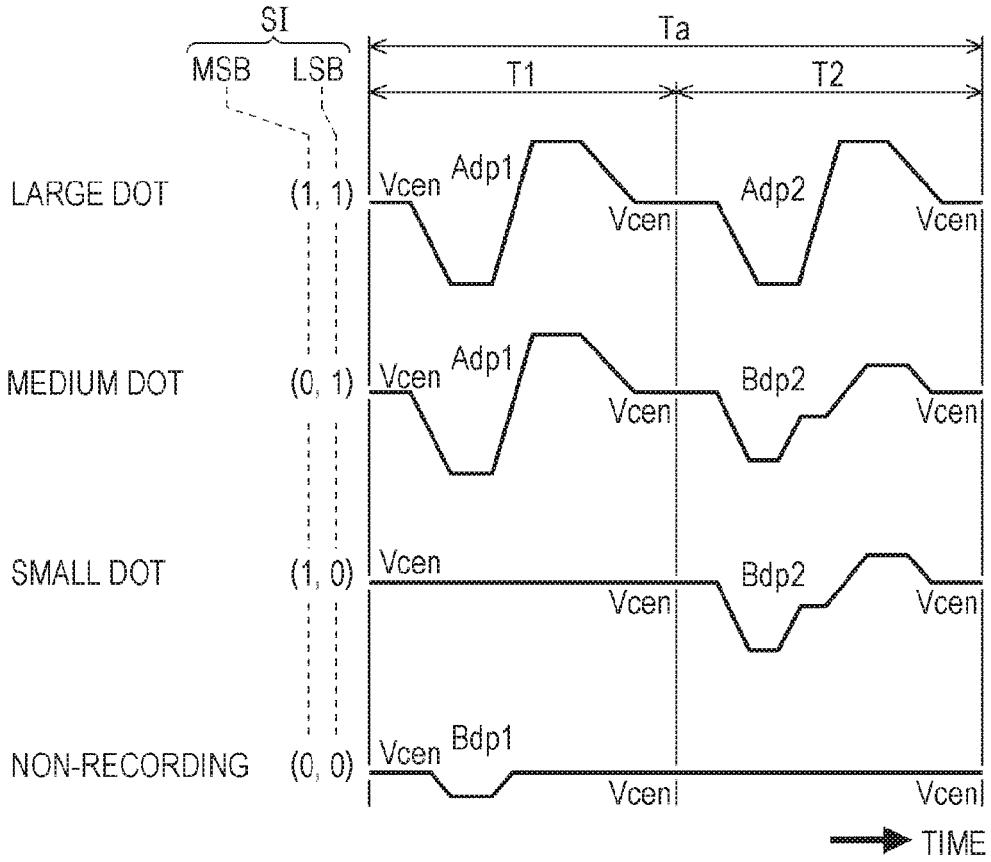
FIG. 16 is a chart showing example waveforms of driving signals that are supplied to a first end of a piezoelectric element.

FIG. 16 is a chart showing the waveforms of driving signals that are selected according to print data SI and supplied to the first end of a piezoelectric element Pzt.

When the print data SI is (1, 1), the selection signals Sa and Sb are at H and L levels, respectively, in the period T1, so that the transfer gate 234*a* is turned on and the transfer gate 234*b* is turned off. Accordingly, the trapezoidal waveform Adp1 of the driving signal COM-A is selected in the period T1. Since the selection signals Sa and Sb are also at H and L levels, respectively, in the period T2, the selection section 230 selects the trapezoidal waveform Adp2 of the driving signal COM-A.

Once the trapezoidal waveforms Adp1 and Adp2 are thus selected in the periods T1 and T2, respectively, and supplied as the driving signal to the first end of the piezoelectric element Pzt, moderate amounts of ink are ejected in a series of two steps from the nozzle N corresponding to the piezoelectric element Pzt. These amounts of ink land on the medium P and combine to form a large dot as defined by the print data SI.

When the print data SI is (0, 1), the selection signals Sa and Sb are at H and L levels, respectively, in the period T1, so that the transfer gate 234*a* is turned on and the transfer gate 234*b* is turned off. Accordingly, the trapezoidal waveform Adp1 of the driving signal COM-A is selected in the period T1. Next, in the period T2, in which the selection signals Sa and Sb are at L and H levels, respectively, the trapezoidal waveform Bdp2 of the driving signal COM-B is selected.

Therefore, moderate and small amounts of ink are ejected in a series of two steps from the nozzle. These amounts of ink land on the medium P and combine to form a medium dot as defined by the print data SI.

When the print data SI is (1, 0), the selection signals Sa and Sb are both at a L level in the period T1, so that the transfer gates 234*a* and 234*b* are turned off. Accordingly, neither of the trapezoidal waveforms Adp1 nor Bdp1 is selected in the period T1. In a case where the transfer gates 234*a* and 234*b* are both turned off, a path from a point of connection between the output terminals of the transfer gates 234*a* and 234*b* to the first end of the piezoelectric element Pzt is brought into a high-impedance state in which the path is not electrically connected to anywhere. However, a voltage ($Vcen-V_{Bs}$) immediately preceding the turning off of the transfer gates is held at both ends of the piezoelectric element Pzt due to the capacitive characteristics of the piezoelectric element Pzt.

Next, in the period T2, in which the selection signals Sa and Sb are at L and H levels, respectively, the trapezoidal waveform Bdp2 of the driving signal COM-B is selected. This causes a small amount of ink to be ejected from the nozzle N only in the period T2 so that a small dot as defined by the print data SI is formed on the medium P.

When the print data SI is (0, 0), the selection signals Sa and Sb are at L and H levels, respectively, in the period T1, so that the transfer gate 234*a* is turned off and the transfer gate 234*b* is turned on. Accordingly, the trapezoidal waveform Bdp1 of the driving signal COM-B is selected in the period T1. Next, in the period T2, in which the selection signals Sa and Sb are both at a L level, neither of the trapezoidal waveforms Adp2 nor Bdp2 is selected.

This merely causes microvibration of ink around the orifice of the nozzle N in the period T1, so the ink is not ejected. This results in the formation of no dot, i.e., results in non-recording as defined by the print data SI.

In this way, each of the selection section 230 selects (or does not select) the driving signal COM-A or COM-B in accordance with an instruction from the selection control section 210, and supplies the driving signal to the first end of the corresponding piezoelectric element Pzt. This causes the piezoelectric elements Pzt to be driven according to the sizes of dots defined by the print data SI, respectively.

It should be noted that the driving signals COM-A and COM-B shown in FIG. 12 are merely examples. In actuality, any of various combinations of waveforms prepared in advance is used depending on the properties of the medium P, the speed of transportation of the medium P, and the like.

The foregoing description has been given by way of an example in which each of the piezoelectric elements Pzt is configured to bend upward in response to a drop in voltage. However, reversal of voltages that are applied to the electrodes 72 and 76 causes the piezoelectric element Pzt to bend upward in response to a rise in voltage. For this reason, when each of the piezoelectric elements Pzt is configured to bend upward in response to a rise in voltage, the driving voltages COM-A and COM-B illustrated in FIG. 12 take on waveforms reversed with the voltage Vcen as a point of reversal.

According to the present embodiment, each of the liquid ejecting units U in the liquid ejecting module 20 is supplied with analog signals of approximately 42 volts such as the driving signals via the relay substrate 160 from the upstream side of the direction of transportation of the medium P and is supplied with digital signals of approximately 3.3 volts such as the clock signal Sck via the assembly substrate 170 from the downstream side of the direction of transportation. This causes the driving signals and the like of high amplitude and the clock signal Sck and the like of low amplitude to be transferred in a separated state until they reach the destination of supply, i.e., the liquid ejecting module 20. This suppresses the interference of noise associated with a change in voltage (e.g., a malfunction due to the influence of a change in voltage of the driving signals and the like of high amplitude on the logic of the clock signal Sck and the like of low amplitude).

Further, there is no need to remove the control unit 10 and the driving substrate 150 from the frame 500 in replacing the liquid ejecting module 20. This enables a shortening of time required for replacement work.

The directions of supply of the driving signals and the like and the clock signal Sck and the like with respect to the liquid ejecting unit U may be interchanged so that the driving signals and the like are supplied from the downstream side of the direction of transportation of the medium P and the clock signal Sck and the like are supplied from the upstream side of the direction of transportation.

Further, the FFCs 169 may be directly joined to the relay substrate 160 by soldering or the like without passing through the connectors P4, as the FFCs 169 are not detached from or attached to the connectors P4 in replacing the liquid ejecting modules 20. Similarly, the FFC 179 may be directly joined to the assembly substrate 170.

What is claimed is:

1. A liquid ejecting apparatus comprising:

a liquid ejecting head having an ejecting section for ejecting liquid;

a driving circuit that generates a driving signal that drives the ejecting section;

a control unit that generates an ejection control signal that controls supply of the driving signal to the ejecting section;

a relay substrate that relays transfer of the driving signal from the driving circuit to the liquid ejecting head;

a first wire via which the driving circuit and the relay substrate are electrically connected to each other, and the driving signal being transferred through the first wire;

a second wire via which the relay substrate and the liquid ejecting head are electrically connected to each other, and the driving signal being transferred through the second wire; and a third wire via which the control unit and the liquid ejecting head are electrically connected to each other without passing through the relay substrate, and the ejection control signal being transferred through the third wire.

2. The liquid ejecting apparatus according to claim 1, wherein the relay substrate is provided in a frame to which the driving circuit and the control unit are attached.

3. The liquid ejecting apparatus according to claim 2, wherein the frame is located between the driving circuit and the liquid ejecting head and between the control unit and the liquid ejecting head, and the relay substrate is provided on a side of the liquid ejecting head.

4. The liquid ejecting apparatus according to claim 1, wherein the control unit has a transmitting section that converts the ejection control signal into a differential signal and outputs the differential signal to the liquid ejecting head, and the liquid ejecting head has a receiving section that receives the differential signal and reversely converts the differential signal into the ejection control signal.

5. The liquid ejecting apparatus according to claim 1, wherein the second wire is detachable from and attachable to the relay substrate via a first connector.

6. The liquid ejecting apparatus according to claim 1, wherein the third wire is detachable from and attachable to the liquid ejecting head via a second connector.

7. The liquid ejecting apparatus according to claim 1, wherein the third wire is capable of transferring the ejection control signal at 3 Gbps or higher.

8. A signal supply apparatus for supplying, with a liquid ejecting head having an ejecting section for ejecting liquid, a driving signal that drives the ejecting section and an ejection control signal that controls supply of the driving signal to the ejecting section, the signal supply apparatus comprising:

a driving circuit that generates the driving signal;

a control unit that generates the ejection control signal; and a relay substrate that relays transfer of the driving signal from the driving circuit to the liquid ejecting head, wherein the driving signal is transferred from the driving circuit to the relay substrate via a first wire, the driving signal is transferred from the relay substrate to liquid ejecting head via a second wire, and the ejection control signal is transferred from the control unit to the liquid ejecting head via a third wire without passing through the relay substrate.

* * * * *